US007610901B2

(12) United States Patent
Bucher et al.

(10) Patent No.: US 7,610,901 B2
(45) **Date of Patent: *Nov. 3, 2009**

(54) METHOD FOR DETECTING THE OPENING OF A PASSIVE PRESSURE CONTROL VALVE

(75) Inventors: Martin Bucher, Bermatingen (DE); Armin Dölker, Friedrichshafen (DE); Volker Wachter, Mengen (DE); Uwe Kosiedowski, Owingen (DE)

(73) Assignee: MTU Friedrichshafen, Friedrichshafen (DE)

( * ) Notice: Subject to any disclaimer, the term of this patent is extended or adjusted under 35 U.S.C. 154(b) by 65 days.

This patent is subject to a terminal disclaimer.

(21) Appl. No.: 11/975,585

(22) Filed: Oct. 19, 2007

(65) Prior Publication Data

US 2008/0092852 A1 Apr. 24, 2008

(30) Foreign Application Priority Data

Oct. 19, 2006 (DE) ..... 10 2006 049 266

(51) Int. Cl.
*F02M 69/54* (2006.01)
*F02M 69/52* (2006.01)

(52) U.S. Cl. ..... 123/457

(58) Field of Classification Search ..... 123/514, 123/457, 458, 506, 480, 456, 459; 701/101–105, 701/107

See application file for complete search history.

(56) References Cited

U.S. PATENT DOCUMENTS 6,578,553 B1 * 6/2003 Schubert et al. ..... 123/458
7,017,549 B2 3/2006 Döelker
7,451,038 B2 * 11/2008 Kosiedowski et al. ..... 701/103
2004/0069278 A1 * 4/2004 Okamoto et al. ..... 123/458

FOREIGN PATENT DOCUMENTS

DE 19626689 C1 * 11/1997
DE 19937962 2/2001
DE 10330466 10/2004
DE 102006040441 10/2006

OTHER PUBLICATIONS

DE19626689 (Guentert Josef et al.) Nov. 20, 1997 (abstract). [online] [retrieved on Feb. 17, 2009]. Retrieved from: EPO website.*

* cited by examiner

*Primary Examiner*—Mahmoud Gimie
(74) *Attorney, Agent, or Firm*—Lucas & Mercanti, LLP; Klaus P. Stoffel

(57) ABSTRACT

A method for detecting the opening of a passive pressure control valve, which conducts fuel from a common rail system back to a fuel tank, in which the rail pressure (pCR) is automatically controlled by calculating a correcting variable for acting on the controlled system from a rail pressure control deviation via a pressure controller, and in which, starting from a steady-state rail pressure in normal operation, a load reduction is detected when the rail pressure exceeds a first limit. Opening of the pressure control valve is detected after the first limit is exceeded if a steady-state operating state is subsequently detected again, and if a characteristic of the closed-loop control system deviates significantly from a reference value.

8 Claims, 4 Drawing Sheets

METHOD FOR DETECTING THE OPENING OF A PASSIVE PRESSURE CONTROL VALVE

BACKGROUND OF THE INVENTION

The invention concerns a method for detecting the opening of a passive pressure control valve, which conducts fuel from a common rail system back to a fuel tank.

In a common rail system, a high-pressure pump pumps the fuel from a fuel tank into a rail. The admission cross section to the high-pressure pump is determined by a variable suction throttle. Injectors are connected to the rail. They inject the fuel into the combustion chambers of the internal combustion engine. Since the quality of the combustion is decisively determined by the pressure level in the rail, this pressure is automatically controlled. The closed-loop high pressure control system comprises a pressure controller, the suction throttle with the high-pressure pump, and the rail as the controlled system. In this closed-loop high pressure control system, the controlled variable is the pressure level in the rail. The measured pressure values in the rail are converted by a filter to an actual rail pressure and compared with a set rail pressure. The control deviation obtained by this comparison is converted to a control signal for the suction throttle by a pressure controller, for example, with PIDT1 response. The control signal corresponds to a volume flow in the unit liters/minute. The control signal is typically electrically generated as a PWM signal (pulse-width-modulated signal). The I component of the pressure controller and the actuating variables, e.g., the PWM signal for acting on the throttle valve, which are derived from the correcting variable, will be referred to as characteristics of the closed-loop control system in the remainder of the text. The closed-loop high pressure control system described above is disclosed in DE 103 30 466 B3.

To protect against an excessively high pressure level, a passive pressure control valve is installed in the rail. If the pressure level exceeds a preset value, the pressure control valve opens to conduct fuel from the rail back to the fuel tank.

The following problem can arise under practical conditions: a load reduction is immediately followed by an increase in engine speed. At a constant set speed, an increasing engine speed causes an increase in the magnitude of the speed control deviation. A speed controller responds to this by reducing the injection quantity as a correcting variable. A smaller injection quantity in turn causes less fuel to be taken from the rail, so that there is a rapid increase in the pressure level in the rail. The situation is further complicated by the fact that the output of the high-pressure pump depends on the engine speed. An increasing engine speed means a higher pump output, and this produces a further increase in pressure in the rail. Since the high pressure control system has a relatively long response time, the rail pressure can continue to rise until the pressure control valve opens, e.g., at 1,950 bars. This causes the rail pressure to drop very rapidly to a value of about 800 bars. At this pressure level, an equilibrium state develops between fuel pumped in and fuel removed. This means that despite the opened pressure control valve, the rail pressure does not drop further. As a result of the pressure loss, the efficiency of the internal combustion engine is reduced, and clearly visible clouding of the exhaust gas occurs.

German Patent Application with the official file number DE 10 2006 040 441.6, for which a prior printed publication has not yet appeared, proposes a method in which, after a load reduction, opening of the passive pressure control valve is detected when the rail pressure exceeds a first limit and a second limit. As an alternative to this, it is provided that opening of the pressure control valve is detected after the first limit if a strongly negative pressure gradient develops or if an impermissible control deviation or correcting variable arises. In practice it has been found that this method is not yet optimum for all operating points.

SUMMARY OF THE INVENTION

Therefore, the objective of the present invention is to improve the previously described method.

Accordingly, opening of the passive pressure control valve is detected after the first limit is exceeded if a steady-state operating state is subsequently present again, and if a characteristic of the closed-loop control system deviates significantly from a reference value. The reference value in turn is read out from a leakage input-output map as a function of the current operating point. The reference value stored in the leakage input-output map corresponds to the value of the selected characteristic in normal operation. The determining characteristic is selected by a software switch.

Although DE 101 57 641 A1 discloses a closed-loop rail pressure control system with a leakage input-output map, the leakage input-output map described there is provided only for emergency operation in connection with a defective rail pressure sensor. In emergency operation, a switch is made from closed-loop operation to open-loop operation. After a transition function ends, the actuating variable for the controlled system is preset by the leakage input-output map.

The method of the invention can be used as a supplement to the prior-art method (DE 10 2006 040 441.6), so that reliable detection of an opened pressure control valve is now possible in all operating points.

Other features and advantages of the present invention will become apparent from the following description of the invention that refers to the accompanying drawings.

BRIEF DESCRIPTION OF THE DRAWINGS

The drawings show a preferred specific embodiment of the invention.

DETAILED DESCRIPTION OF THE INVENTION

Figure 1:
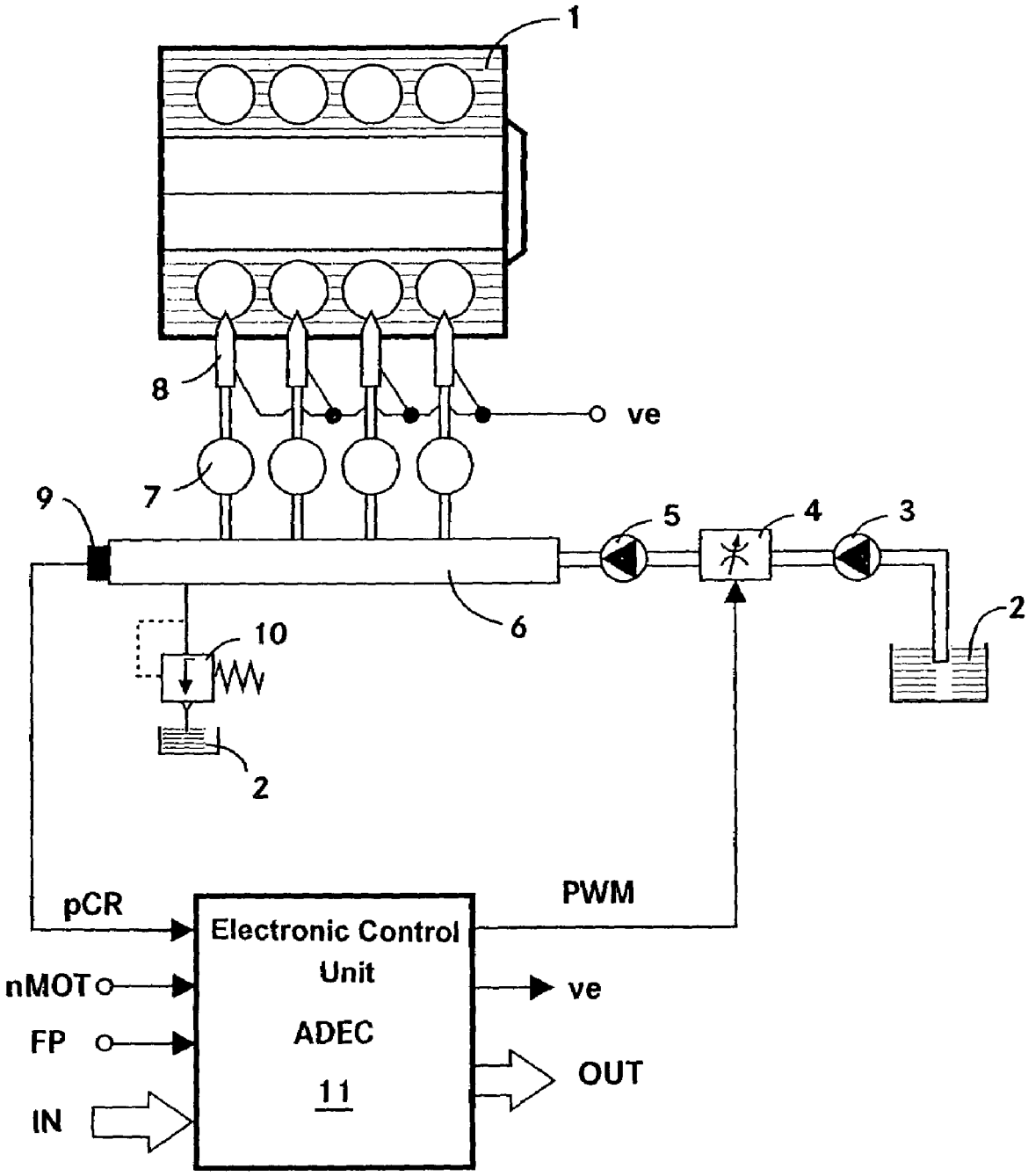
FIG. 1 shows a system diagram.

FIG. 1 shows a system diagram of an internal combustion engine 1 with a common rail injection system. The common rail system comprises the following components: a low-pressure pump 3 for delivering fuel from a fuel tank 2, a variable suction throttle 4 for controlling the volume flow of the fuel flowing through the system, a high-pressure pump 5 for pumping the fuel at increased pressure, a rail 6 and individual accumulators 7 for storage of the fuel, and injectors 8 for injecting the fuel into the combustion chambers of the internal combustion engine 1.

This common rail system is operated at a maximum steady-state rail pressure of 1,800 bars. To protect against an impermissibly high pressure level in the rail 6, a passive pressure control valve 10 is provided. It opens at a pressure level of 1,950 bars. In the opened state, the fuel is routed out of the rail 6 and into the fuel tank 2 via the pressure control valve 10. This causes the pressure level in the rail 6 to drop to a value of about 800 bars.

The mode of operation of the internal combustion engine 1 is determined by an electronic control unit (ADEC) 11. The electronic control unit 11 contains the usual components of a microcomputer system, for example, a microprocessor, I/O modules, buffers, and memory components (EEPROM, RAM). Operating characteristics that are relevant to the operation of the internal combustion engine 1 are applied in the memory components in input-output maps/characteristic curves. The electronic control unit 11 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable IN. Examples of input variables (IN) are the charge air pressure of the exhaust gas turbochargers and the temperatures of the coolants/lubricants and the fuel.

As output variables of the electronic control unit 11, FIG. 1 shows a signal PWM for controlling the suction throttle 4, a signal for controlling the injectors 8, and an output variable OUT. The output variable OUT is representative of additional control signals for controlling and regulating the internal combustion engine 1, for example, a control signal for activating a second exhaust gas turbocharger in register supercharging.

Figure 2:
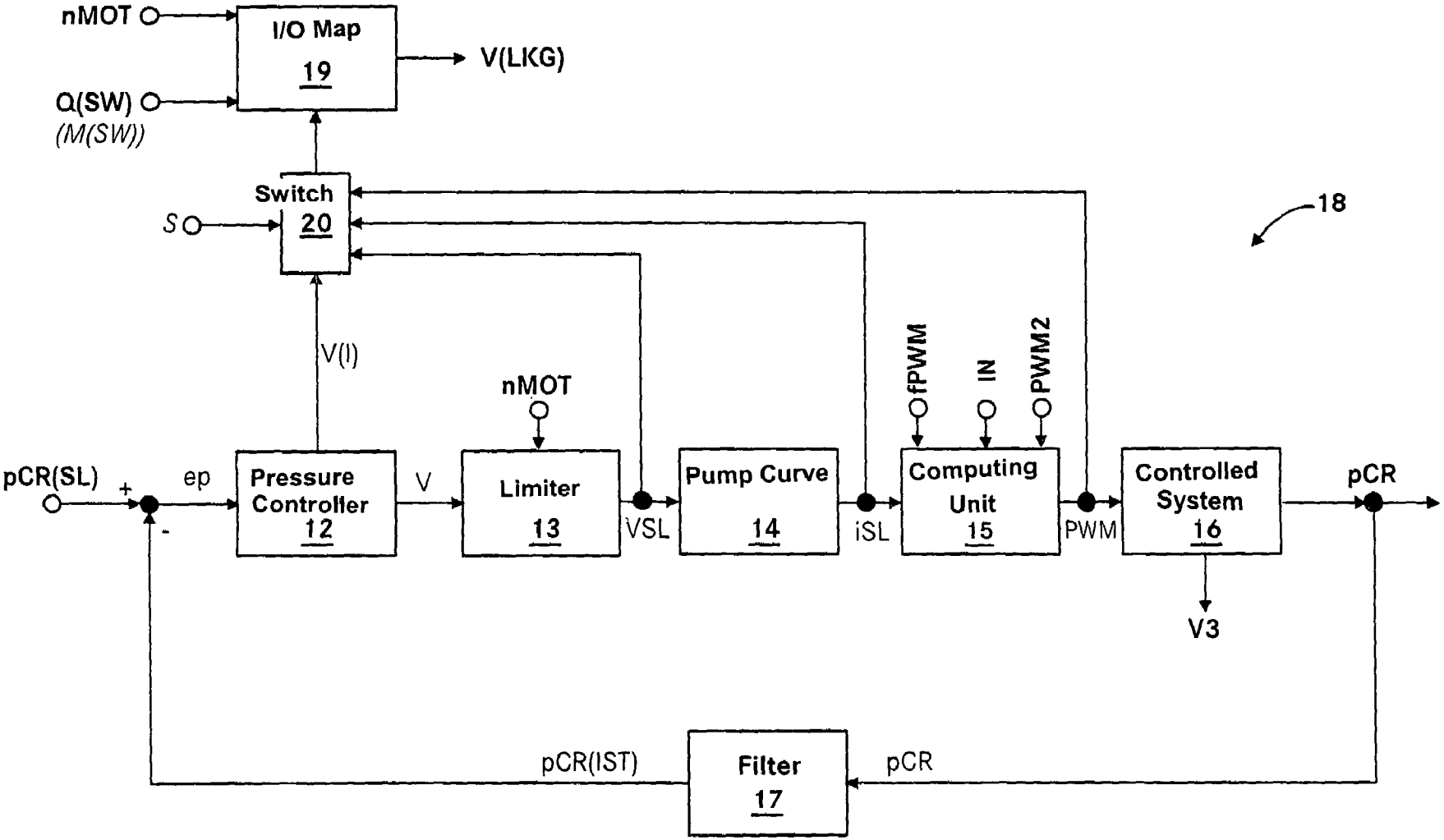
FIG. 2 shows a closed-loop pressure control system.

FIG. 2 shows a closed-loop pressure control system 18. The input variables are a set rail pressure pCR(SL), the engine speed nMOT, a base frequency FPWM for the PWM signal, a PWM signal PWM2, and a variable IN, for example, a battery voltage. The output variable corresponds to the raw value of the rail pressure pCR. An actual rail pressure pCR(IST) is determined from the raw value of the rail pressure pCR by means of a filter 17. This value is compared with the set value pCR(SL) at a summation point, and a control deviation ep is obtained from this comparison. A correcting variable is calculated from the control deviation ep by means of a pressure controller 12. The pressure controller 12 is typically realized as a PIDT1 controller. The correcting variable represents a volume flow V. The physical unit of the volume flow is liters per minute. In an optional provision, the calculated set consumption is added to the volume flow. The volume flow V is the input variable for a limiter 13, which can be made speed-dependent by using nMOT as an input variable. The output variable of the limiter 13 is a set volume flow VSL, which is the input variable of a pump characteristic curve 14. The pump characteristic curve 14 assigns a set electric current iSL to the set volume flow VSL, with a decreasing set current iSL being assigned to an increasing set volume flow VSL, since the suction throttle 4 is open in the currentless state. The set current iSL is then converted in a computing unit 15 to a PWM signal PWM. The PWM signal represents the duty cycle, and the frequency fPWM corresponds to the base frequency. The signal PWM2 corresponds to a PWM value that can be temporarily preset, which is increased relative to normal operation, for example, 80%, and is optionally output when a load reduction is detected. Fluctuations in the operating voltage and the fuel admission pressure are also taken into consideration in the conversion. The magnetic coil of the suction throttle is then acted upon by the PWM signal PWM. This changes the displacement of the magnetic core, and the output of the high-pressure pump is freely controlled in this way. The high-pressure pump, the suction throttle, the rail, and the individual accumulators represent a controlled system 16. A set consumption volume flow V3 is removed from the rail 6 through the injectors 8. The closed-loop control system is thus closed.

This closed-loop pressure control system 18 is completed by a leakage input-output map 19 and a switch 20. One of the characteristics of the closed-loop control system 18 is selected as the determining characteristic by the switch 20. The characteristics of the closed-loop control system 18 are understood to mean the I component of the pressure controller 12 and the actuating variables derived from its correcting variable V. The derived actuating variables are the set volume flow VSL, the set current iSL, and the PWM signal PWM, which acts on the controlled system 16. The position of the switch 20 is preset by a signal S. A leakage volume flow V(LKG) is determined by the leakage input-output map 19 as a function of the engine speed nMOT and a set injection quantity Q(SW). If a torque-oriented architecture is used, a torque set value M(SW) is used instead of the set injection quantity Q(SW) as the input variable of the leakage input-output map 19. The leakage input-output map 19 contains the data of the characteristic that has been set as the determining characteristic in normal operation. The output variable of the leakage input-output map 19, i.e., the leakage volume flow V(LKG), can be used as the actuating variable for the controlled system 16 in case of failure of the rail pressure sensor. In accordance with the invention, the leakage volume flow V(LKG) is also used as a reference value for monitoring the passive pressure control valve.

The system has the following functionality:

The I component of the pressure controller 12, in this case a volume flow V(I), was selected via the signal S and the switch 20 as the determining input variable to be furnished to the leakage input-output map 19. If the rail pressure pCR exceeds a first limit of 1,920 bars, a check is made to determine whether a steady-state operating state is present again after this value has been exceeded. A steady-state operating state is characterized by a constant engine speed nMOT and a constant rail pressure pCR. In practice, the first limit is set to a value that is below the opening pressure of the pressure control valve of 1,950 bars. If a steady-state operating state is subsequently detected, the operating point-specific leakage volume flow V(LKG) is read from the leakage input-output map 19 as a reference value and compared with the currently calculated value of the I component. An opened passive pressure control valve is detected on the basis of the fact that the selected characteristic of the closed-loop control system, in this case the I component, differs significantly from the reference value. If the pressure control valve is open, the operator is then informed, and the power output of the internal combustion engine is limited.

Figure 3:
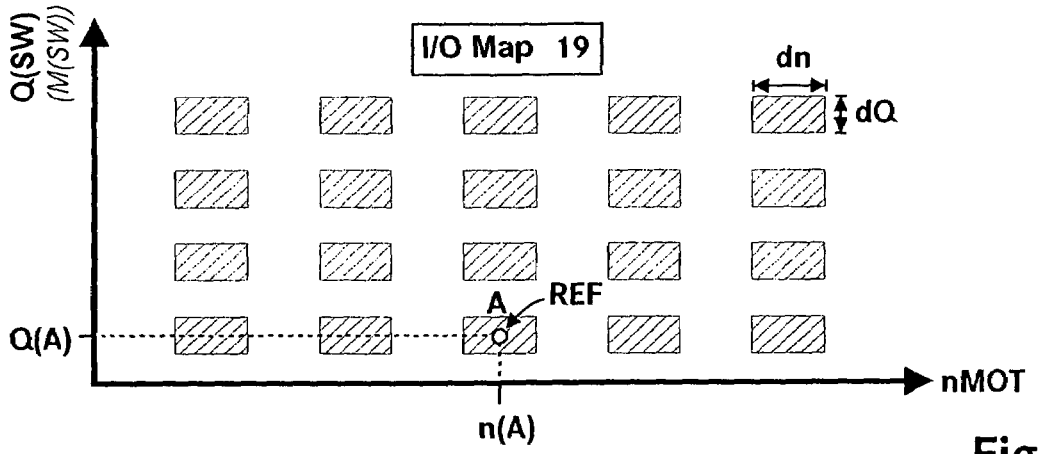
FIG. 3 shows a leakage input-output map.

FIG. 3 shows the leakage input-output map 19 for determining the leakage volume flow V(LKG). The engine speed nMOT is plotted on the x-axis. The set injection quantity Q(SW) is plotted on the y-axis as the second input variable. In a torque-based architecture, the second input variable is a set torque M(SW). The z-axis corresponds to the leakage volume flow V(LKG). A predeterminable operating range is assigned to each node in the input-output map. The operating ranges are represented in FIG. 3 as shaded areas. An operating range of this type is defined by the quantities dn and dQ. Typical values are, e.g., 100 revolutions per minute and 50 cubic millimeters per stroke. In the case of a torque-oriented architecture, a quantity dM is used instead of the quantity dQ. In FIG. 3, a node A is plotted as an example. This node is obtained from the two input values n(A) equal to 3,000 revolutions per minute and Q(A) equal to 40 cubic millimeters per stroke. A leakage volume flow V(LKG) of, for example, 7.2 liters/minute, is assigned to the node A as the z value.

The z values of the input-output map 19 are always determined in normal operation when the common rail injection system is in a steady state, for example, in the operating point n(A) and Q(A). The z values correspond to the values of the selected characteristic of the closed-loop control system.

Depending on the position of the switch 20, this is either the I component V(I) of the pressure controller or one of the actuating variables derived from the correcting variable, i.e., the actuating variable set volume flow VSL or set current iSL or the value of the PWM signal PWM. The stored values represent a measure of the leakage of the common rail system. The value of point A at this operating point n(A)/Q(A) serves as a reference value REF for evaluating the switching state of the passive pressure control valve. For example, if the I component V(I) has a value of 15 liters/minute, and the reference value REF (point A) has a value of 7.2 liters per minute, the difference between the two values is calculated to be 7.8 liters per minute. An opened pressure control valve is detected on the basis of the fact that this difference is greater than a limit, for example, 5 liters per minute. Instead of the difference, a percent deviation of the two values can be compared with a limit.

Figure 4A:
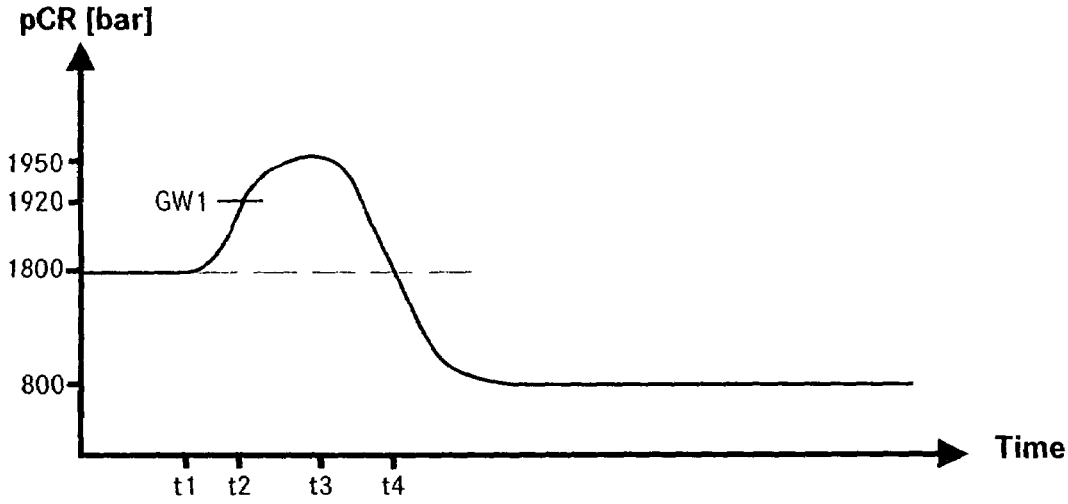
FIG. 4 shows a time diagram.
Figure 4B:
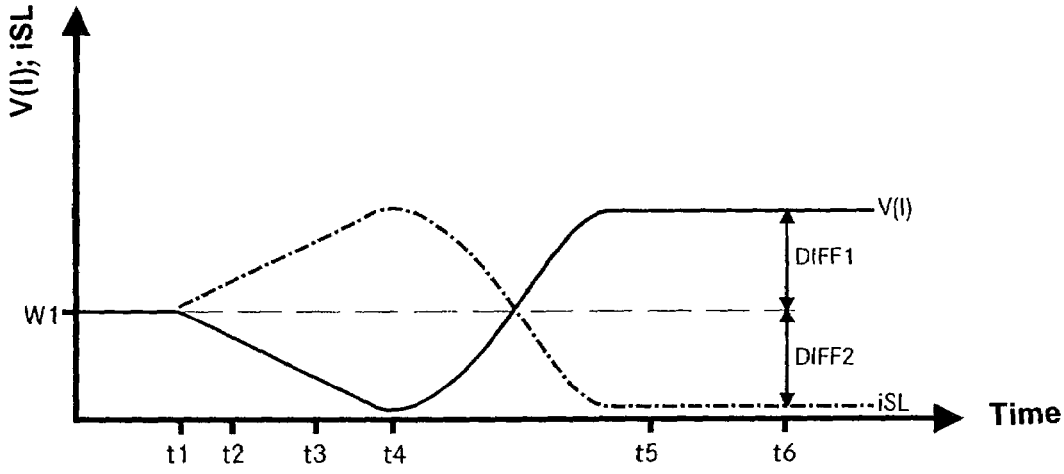

FIG. 4 comprises FIGS. 4A and 4B, which show the rail pressure pCR in bars as a function of time and the characteristics of the closed-loop control system as a function of time, with, for example, the I component V(I) of the pressure controller plotted as a solid line, and with the set current iSL plotted as a broken line. The plots of the I component V(I) and of the set current iSL are inverse with respect to each other. The plot of the set volume flow VSL in the steady-state operating state corresponds qualitatively to that of the I component V(I) of the pressure controller. The plot of the PWM signal PWM corresponds to the plot of the set current iSL in the period of time under consideration. In the further description of FIG. 4B, it is assumed that the I component of the pressure controller was selected as the characteristic by the switch 20, i.e., the z values of the leakage input-output map correspond to the value V(I).

At time t1 the internal combustion engine is in a steady state in normal operation. The rail pressure pCR is 1,800 bars, which is the maximum rail pressure in the steady state. Due to a load reduction, the rail pressure starts to increase after t1. A load reduction occurs when a marine propulsion unit breaks above the surface of the water or a generator load in an emergency power generating unit is disconnected. At a constant set rail pressure, this increasing rail pressure pCR causes a likewise (negatively) increasing control deviation ep and thus an I component V(I) of the pressure controller that decreases from the initial value W1. The plot of the set current iSL is the mirror image of the plot of the I component V(I). At time t2 the rail pressure pCR exceeds a first limit GW1, which in the present case is 1,920 bars. At the same time, monitoring is being performed to determine whether a steady-state operating state is subsequently present. A steady-state operating state is characterized by a constant engine speed nMOT and a constant rail pressure pCR. At time t2, a constant operating state does not exist, since the rail pressure pCR continues to rise, and at time t3 the passive pressure control valve opens at about 1,950 bars. This results in a sharp drop in the rail pressure pCR. At time t4 the rail pressure pCR reaches the initial pressure level of 1,800 bars and then falls below this pressure level. Since a positive control deviation ep is now present, the I component V(I) starts to increase again at time t4. At time t5 the system has returned to a steady state, since an equilibrium becomes established between delivered and removed fuel.

When this steady-state operating state has been detected, a check is performed to determine whether the I component V(I) of the pressure controller deviates significantly from the reference value REF which is read from the leakage input-output map in accordance with this operating point. This is the case here, so that at time t6 it is detected that the passive pressure control valve has opened. Accordingly, in FIG. 4B, a deviation with respect to the I component V(I) is drawn in as DIFF1, and a deviation with respect to the set current iSL is drawn in as DIFF2. When the unplanned opening of the pressure control valve is detected, the operator is informed about the disturbance which has occurred, and recommended actions are presented, for example, a reduction of the power demand, the initiation of an idling operation, or an emergency stop.

Figure 5:
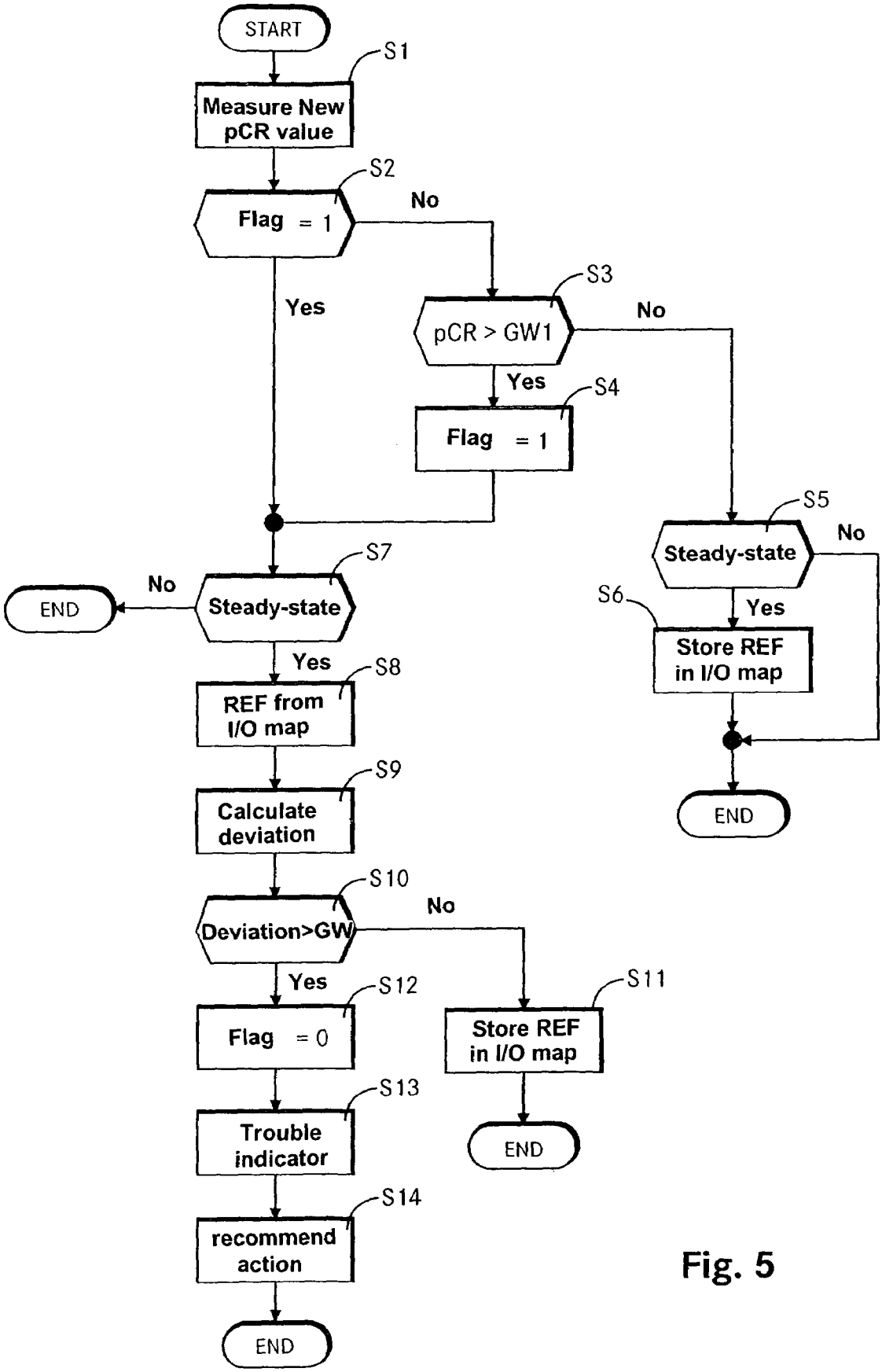
FIG. 5 shows a program flowchart.

FIG. 5 shows a program flowchart for the method of the invention. After the program start, a new value of the rail pressure pCR is measured at S1, and a flag is interrogated for a value of one at S2. If the flag is zero, i.e., interrogation result at S2: no, then program control passes to the routine with steps S3 to S6; otherwise, the program continues at S7.

If the flag is zero, then a check is made at S3 to determine whether the rail pressure pCR is greater than the first limit GW1, for example, 1,920 bars. If this is the case, i.e., interrogation result S3: yes, the flag is set to the value one at S4, and the program continues at S7. If the check at S3 shows that the rail pressure pCR is less than the first limit GW1, then a check is performed at S5 to determine whether a steady-state operating state exists. If a steady-state operating state does exist, then at S6 the selected characteristic of the closed-loop control system, for example, the I component V(I) of the pressure controller is stored in the leakage input-output map as operating point-specific reference value REF. If a steady-state operating state does not exist, i.e., interrogation result S5: no, then this routine is ended.

If the interrogation at S2 shows that the flag has the value one, or if it was detected at S3 that the rail pressure pCR is greater than the first limit GW1, then a check is performed at S7 to determine whether a steady-state operating state is present. If a steady-state operating state does not exist, i.e., interrogation result S7: no, then this routine is ended. Otherwise, the reference value REF that corresponds to the operating point is read out from the leakage input-output map at S8. At S9 a deviation of the current value of the selected characteristic of the closed-loop control system from the reference value is calculated. The deviation is calculated either as the difference of the two values or as the percent deviation. At S10 a check is then made to determine whether a significant deviation is present. This is done by comparing the deviation with a limit GW. If the deviation is smaller than the limit GW, i.e., interrogation result S10: no, then at S11 the current value of the characteristic of the closed-loop control system is stored as a new operating point-specific reference value REF in the leakage input-output map, and the program is ended. On the other hand, if the check at S10 shows that the deviation is greater than the limit, this is interpreted as an unplanned opening of the pressure control valve. At S12 the flag is then set to the value zero. At S13 the operator is then informed about the disturbance which has occurred, and at S14 recommended actions are presented, for example, a reduction of the power demand, the initiation of an idling operation, or an emergency stop. This ends the program flow.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A method for detecting opening of a passive pressure control valve, which conducts fuel from a common rail system back to a fuel tank, comprising the steps of: automatically controlling rail pressure (pCR) by calculating a correcting variable for acting on a controlled system from a rail pressure control deviation (ep) via a pressure controller; detecting, starting from a steady-state rail pressure in normal operation, a load reduction when the rail pressure (pCR) exceeds a first limit (GW1); and detecting opening of a pressure control valve after the first limit (GW1) is exceeded if a steady-state operating state is subsequently detected again, and if a characteristic of a closed-loop control system deviates significantly from a reference value (REF).

2. The method in accordance with claim 1, including reading out the reference value (REF) from a leakage input-output map as a function of a current operating point.

3. The method in accordance with claim 2, including determining the current operating point by engine speed (nMOT) and a set injection quantity (Q(SW)) or, alternatively, a set torque (M(SW)).

4. The method in accordance with claim 1, including determining the characteristic of the closed-loop control system from an I component (V(I)) of the pressure controller or from an actuating variable derived from the correcting variable of the pressure controller.

5. The method in accordance with claim 4, wherein the actuating variable is a set volume flow (VSL), a set electric current (iSL), or a PWM signal (PWM).

6. The method in accordance with claim 5, wherein a significant deviation is present when the I component (V(I)) of the pressure controller or the set volume flow (VSL) becomes greater than the reference value (REF).

7. The method in accordance with claim 5, wherein significant deviation is present when the set electric current (iSL) or the PWM signal (PWM) becomes smaller than the reference value (REF).

8. A method in accordance with claim 2, including determining the reference value (REF) stored in the leakage input-output map from one of the characteristics of the closed-loop control system in normal operation.

* * * * *